US010364638B2

(12) United States Patent
Hallundbæk et al.

(10) Patent No.: US 10,364,638 B2
(45) Date of Patent: Jul. 30, 2019

(54) ANNULAR BARRIER

(71) Applicant: Welltec Oilfield Solutions AG, Zug (CH)

(72) Inventors: Jørgen Hallundbæk, Græsted (DK); Paul Hazel, Aberdeen (GB); Thomas Sune Andersen, Helsingør (DK)

(73) Assignee: Welltec Oilfield Solutions AG, Zug (CH)

( * ) Notice: Subject to any disclaimer, the term of this patent is extended or adjusted under 35 U.S.C. 154(b) by 43 days.

(21) Appl. No.: 15/097,848

(22) Filed: Apr. 13, 2016

(65) Prior Publication Data

US 2016/0222754 A1 Aug. 4, 2016

Related U.S. Application Data

(62) Division of application No. 13/500,765, filed as application No. PCT/EP2010/064988 on Oct. 7, 2010, now abandoned.

(30) Foreign Application Priority Data

Oct. 7, 2009 (EP) ..... 09172466

(51) Int. Cl.
*E21B 33/127* (2006.01)

(52) U.S. Cl.
CPC ..... *E21B 33/127* (2013.01); *E21B 33/1277* (2013.01)

(58) Field of Classification Search
CPC ..... E21B 33/127; E21B 33/1277
See application file for complete search history.

(56) References Cited

U.S. PATENT DOCUMENTS 4,349,204 A 9/1982 Malone
4,403,660 A 9/1983 Coone
(Continued)

FOREIGN PATENT DOCUMENTS

CN 2707948 Y 7/2005
EP 1 624 152 A2 2/2006
(Continued)

OTHER PUBLICATIONS

International Search Report for PCT/EP2010/064988 dated Nov. 11, 2010.

(Continued)

*Primary Examiner* — Kristyn A Hall
(74) *Attorney, Agent, or Firm* — Nixon & Vanderhye P.C.

(57) ABSTRACT

The present invention relates to an annular barrier to be expanded in an annulus between a well tubular structure and an inside wall of a borehole downhole. The annular barrier comprises a tubular part for mounting as part of the well tubular structure, an expandable sleeve surrounding the tubular part and having an inner face facing the tubular part, each end of the expandable sleeve being connected with a connection part which is connected with the tubular part, a space between the inner face of the sleeve and the tubular part, and an element arranged in connection with the sleeve, the element having a first part and a second part both of which extend around the inner face, the first part of the element being fastened to the inner face.

17 Claims, 19 Drawing Sheets

(56) References Cited

U.S. PATENT DOCUMENTS

| | | | | |
|---|---|---|---|---|
| 4,614,346 | A * | 9/1986 | Ito | F16J 15/46 166/187 |
| 4,658,897 | A | 4/1987 | Kompanek et al. | |
| 5,220,959 | A * | 6/1993 | Vance, Sr. | E21B 33/1277 166/122 |
| 5,495,892 | A | 3/1996 | Carisella | |
| 6,581,682 | B1 | 6/2003 | Parent et al. | |
| 2005/0072579 | A1 | 4/2005 | Gambier | |
| 2005/0161232 | A1 | 7/2005 | Patel et al. | |
| 2009/0205843 | A1 | 8/2009 | Gandikota et al. | |
| 2012/0199339 | A1 | 8/2012 | Hallundbæk et al. | |

FOREIGN PATENT DOCUMENTS

| | | |
|---|---|---|
| GB | 2320734 | 7/1998 |
| GB | 2347702 | 9/2000 |
| GB | 2 406 593 A | 4/2005 |
| RU | 2 224 872 C1 | 2/2004 |
| RU | 2362006 C2 | 7/2009 |
| SU | 972043 A1 | 11/1982 |

OTHER PUBLICATIONS

International Preliminary Report on Patentability dated Jan. 16, 2012.

Communication Pursuant to Article 94(3) EPC dated Jun. 12, 2017 in European Application No. 10 762 677.2 (6 pages).

* cited by examiner

ANNULAR BARRIER

CROSS REFERENCE TO RELATED APPLICATIONS

This application is a divisional of U.S. application Ser. No. 13/500,765, filed Apr. 6, 2012, now abandoned, which is the U.S. national phase of International Application No. PCT/EP2010/064988 filed 7 Oct. 2010 which designated the U.S. and claims priority to EP 09172466.6 filed 7 Oct. 2009, the entire contents of each of which are hereby incorporated by reference.

FIELD OF THE INVENTION

The present invention relates to an annular barrier to be expanded in an annulus between a well tubular structure and an inside wall of a borehole downhole. The annular barrier comprises a tubular part for mounting as part of the well tubular structure, an expandable sleeve surrounding the tubular part and having an inner face facing the tubular part, each end of the expandable sleeve, the expandable sleeve being connected with a connection part which is connected with the tubular part, a space between the inner face of the sleeve and the tubular part, and an element arranged in connection with the sleeve, the element having a first part and a second part both of which extend around the inner face, the first part of the element being fastened to the inner face.

BACKGROUND ART

In wellbores, annular barriers are used for different purposes, such as for providing a barrier for flowing between an inner and an outer tubular structure or between an inner tubular structure and the inner wall of the borehole. The annular barriers are mounted as part of the well tubular structure. An annular barrier has an inner wall surrounded by an annular expandable sleeve. The expandable sleeve is typically made of an elastomeric material, but may also be made of metal. The sleeve is fastened at its ends to the inner wall of the annular barrier.

In order to seal off a zone between an inner and an outer tubular structure or a well tubular structure and the borehole, a second annular barrier is used. The first annular barrier is expanded on one side of the zone to be sealed off, and the second annular barrier is expanded on the other side of that zone, and in this way, the zone is sealed off.

The pressure envelope of a well is governed by the burst rating of the tubular and the well hardware etc. used within the well construction. In some circumstances, the expandable sleeve of an annular barrier may be expanded by increasing the pressure within the well, which is the most cost efficient way of expanding the sleeve. The burst rating of a well defines the maximum pressure that can be applied to the well for expansion of the sleeve, and it is desirable to minimise the expansion pressure required for expanding the sleeve to minimise the exposure of the well to the expansion pressure.

When expanded, annular barriers may be subjected to a continuous pressure or a periodic high pressure from the outside, either in the form of hydraulic pressure within the well environment or in the form of formation pressure. In some circumstances, such pressure may cause the annular barrier to collapse, which may have severe consequences for the area which the barrier is to seal off as the sealing properties are lost due to the collapse. A similar problem may arise when the expandable sleeve is expanded by means of e.g. a pressurised fluid. If the fluid leaks from the sleeve, the back pressure may fade, and the sleeve itself may thus collapse.

The ability of the expanded sleeve of an annular barrier to withstand the collapse pressure is thus affected by many variables, such as strength of material, wall thickness, surface area exposed to the collapse pressure, temperature, well fluids, etc.

A collapse rating currently achievable of the expanded sleeve within certain well environments is insufficient for all well applications. Thus, it is desirable to increase the collapse rating to enable annular barriers to be used in all wells, specifically in wells that experience a high drawdown pressure during production and depletion. The collapse rating may be increased by increasing the wall thickness or the strength of the material; however, this would increase the expansion pressure, which as mentioned is not desirable.

It is thus desirable to provide a solution wherein the collapse rating of expanded sleeves is increased.

SUMMARY OF THE INVENTION

It is an object of the present invention to wholly or partly overcome the above disadvantages and drawbacks of the prior art. More specifically, it is an object to provide an improved annular barrier with an increased collapse rating of the expandable sleeve.

A further object of the present invention is to provide an annular barrier having an increased collapse rating without increasing the strength of the material and/or wall thickness of the sleeve.

An additional object of the present invention is to provide an annular barrier having a higher collapse rating for the same strength in material and the same wall thickness of the expandable sleeve, and/or the same collapse rating for a lesser strength in material or a lesser wall thickness of the expandable sleeve, enabling a lower expansion pressure to be used.

The above objects, together with numerous other objects, advantages, and features, which will become evident from the below description, are accomplished by a solution in accordance with the present invention by an annular barrier to be expanded in an annulus between a well tubular structure and an inside wall of a borehole downhole, comprising

- a tubular part for mounting as part of the well tubular structure,
- an expandable sleeve surrounding the tubular part and having an inner face facing the tubular part, each end of the expandable sleeve being connected with a connection part which is connected with the tubular part,
- a space between the inner face of the sleeve and the tubular part, and
- an element arranged in connection with the sleeve, the element having a first part and a second part both of which extend around the inner face, the first part of the element being fastened to the inner face, wherein the second part projects into the space from the first part.

When the sleeve is expanded, the second part projects substantially radially out into the space, or at an angle of up to a 45°. In the unexpanded state of the sleeve, the second part abuts the inner face of the sleeve extending from the first part and the element is substantially unbent in relation to the first part. Thus, the second part projects substantially axially along the inner face of the sleeve with only a small gap between the inner face of the sleeve and the second part.

The collapse rating of the expandable sleeve is thus increased without increasing the strength of the material, the wall thickness of the expandable sleeve or the overall diameter of the annular barrier. Furthermore, by the present invention, the expansion pressure necessary to expand the expandable sleeve will not be increased or may even be lowered.

The first part of the element, which is fastened to the inner face of the sleeve, will follow the sleeve outwards during expansion of the sleeve, the diameter of the first part thus being increased. The second part of the element is not fastened to the inner face of the sleeve. When the sleeve is expanded, the second part will follow the first part outwards in the area where they are connected, but not in its other end. The other end of the second part will project inwards towards the tubular part and thus extend substantially radially inward from the sleeve. The second part of the element will thus project inwards at an angle different from the first part.

That the second part projects into the space from the first part is to be understood thus that, in the unexpanded state of the sleeve, the second part projects from first part at an angle of 0°-15°.

In the expanded state of the sleeve, both the first and second parts of the element will add additional strength to expanded sleeve as well as a high resistance to collapse. Furthermore, in this state, the second part of the element will function as an internal frame structure of the sleeve having a momentum of resistance in a direction substantially perpendicular to the sleeve which is higher than the momentum of resistance of the first part.

In addition, the sections of the expanded sleeve which are fastened to the first part of the element will have a reduced outer diameter, resulting in a corrugated expanded sleeve. The corrugations will be annular and strengthen the expanded sleeve even further.

As a consequence, the annular barrier according to invention is able to withstand a higher collapse pressure than prior art annular barriers and will thus also have enhanced sealing capabilities.

In an embodiment, the second part may have an angle in relation to the first part before the expandable sleeve is expanded, and the angle changes during expansion of the expandable sleeve.

Furthermore, the angle prior to expansion may be 0-20°, preferably 0-5°.

In addition, the angle after expansion may be 45-120°, preferably 45-100°, more preferably 50-90°.

Moreover, the second part may be arranged for free movement in the space and projects inwards in the space during expansion of the sleeve.

Additionally, the second part may be free and unrestrained of the inner face.

Also, the second part may be movable and able to extend radially inwards towards the tubular part during expansion of the sleeve.

Furthermore, the second part may form an angle of at least 45° in relation to the first part during expansion of the sleeve.

In an embodiment, the sleeve after expansion may have two inclining parts and an intermediate non-inclining part when seen in cross-section along a longitudinal extension of the sleeve, and the element may be arranged on the part of the sleeve which is non-inclining.

Moreover, the element may be made of a material able to maintain its shape after being bent, such as metal.

Additionally, the element may be made of metal, such as steel or stainless steel.

Also, the expandable sleeve may have an outer face onto which at least one sealing element is arranged opposite the first part of the element.

In one embodiment of the annular barrier according to the present invention, the element may extend along an entire inner periphery of the sleeve, e.g. as a ring, providing an interior support structure in the expanded state of the sleeve all around the inner periphery.

A plurality of elements may be arranged in connection with the sleeve. These elements are distributed with an even or uneven distance between them along a longitudinal direction of the sleeve and extend along the periphery. They may be positioned in areas of the expandable sleeve which require more strength than other areas, as these areas are exposed to higher collapse pressure than other areas.

The plurality of elements may be arranged in connection with the sleeve and have a mutual distance between them, all connected to the non-inclining part of the sleeve.

Furthermore, the sealing elements may have a tapering or triangular cross-sectional shape.

In one embodiment, the element may extend in a longitudinal direction as well as along the periphery of the sleeve, thereby creating a helical path along the inner face of the sleeve seen in the longitudinal direction of the sleeve.

In addition, the element may comprise a third part which is free and unrestrained of the inner face and arranged opposite the second part so that the first part is arranged between the third and second parts.

Furthermore, both the second and the third part of the element may be adapted to change their angle in relation to the first part during expansion of the expandable sleeve.

Advantageously, the second and third parts are arranged on each side of the first part so that the element a substantially U-shaped or C-shaped cross-sectional configuration in the expanded state of the sleeve, and thus providing an interior support frame structure for the expanded sleeve.

Furthermore, the second and/or the third part of the element may have an angle in an expanded state of the sleeve in relation to the inner face being larger than 5°.

The first part may be fastened wholly or partly to the inner face or an outer face of the sleeve. In one embodiment, the first part may be fastened to the inner face at the transition between the first and second/third parts or along an entire width of the first part so that the second and third parts, respectively, are free in relation to the inner sleeve.

Moreover, the second part and/or third part of the element may function as a frame structure for the expanded sleeve.

The element may have a V-shaped, a U-shaped, a C-shaped, or an L-shaped cross-sectional configuration when the sleeve is expanded.

The first part may be welded, glued, bolted, or riveted to the inner face.

In one embodiment, the expandable sleeve may be made of metal or a composite. In another embodiment, it may be made of polymers, such as an elastomeric material, silicone, or natural or syntactic rubber.

The element may also be made of metal or polymers.

In one embodiment, the first part may have a width between 0.005 m and 0.30 m, preferably between 0.01 m and 0.10 m and more preferably between 0.01 m and 0.05 m. The second part may have a width of between 0.01 m and 0.30 m, preferably between 0.01 m and 0.1 m, more preferably between 0.01 m and 0.05 m.

The expandable sleeve may be capable of expanding to an at least 10% larger diameter, preferably an at least 15% larger diameter, more preferably an at least 30% larger diameter than that of an unexpanded sleeve and it may have a wall thickness which is thinner than a length of the expandable sleeve, the thickness preferably being less than 25% of its length, more preferably less than 15% of its length, and even more preferably less than 10% of its length.

In one embodiment, the expandable sleeve may have a varying thickness along the periphery and/or length.

In addition, at least one of the connection part may be slidable in relation to the tubular part of the annular barrier, and at least one sealing element, such as an O-ring, may be arranged between the slidable connection part and the tubular part. In one embodiment, more than one sealing element may be arranged between the slidable fastening means and the tubular part.

At least one of the connection part may be fixedly fastened to the tubular part or be part of the tubular part.

The connection part may have a projecting edge part which projects outwards from the tubular part.

In one embodiment of the annular barrier according to the invention, the element may be substituted for at least one section having an increased thickness in relation to another section of the sleeve when seen in cross-section along a longitudinal extension of the sleeve, causing the section having the increased thickness to be expanded less than another section during expansion of the sleeve is.

Furthermore, the present invention also relates to an annular barrier to be expanded in an annulus between a well tubular structure and an inside wall of a borehole downhole, comprising:

- a tubular part for mounting as part of the well tubular structure,
- an expandable sleeve having a longitudinal extension and surrounding the tubular part and having an inner face facing the tubular part, each end of the expandable sleeve being connected with a connection part which is connected with the tubular part, and
- a space between the inner face of the sleeve and the tubular part, wherein the sleeve when seen in cross-section along its longitudinal extension has at least one section having an increased thickness in relation to another section of the sleeve so that the section having the increased thickness is expanded less than another section when the sleeve is expanded.

The section having the increased thickness may be circumferential.

Moreover, when expanded, the sleeve may have two inclining parts and an intermediate non-inclining part seen in cross-section, and the section having the increased thickness may be arranged on the non-inclining part of the sleeve.

The section of the sleeve having an increased thickness may be provided by fastening a ring-shaped part onto the sleeve.

The ring-shaped part may be fastened by welding and, in one embodiment, the ring-shaped part may be fastened to an outer face of the sleeve.

In addition, the section of the sleeve having an increased thickness may have two inclining end parts in which the thickness of the sleeve increases.

The expandable sleeve may have an outer face onto which at least one sealing element is arranged opposite the section of the sleeve having an increased thickness.

Moreover, at least one sealing element may be arranged adjacent to the section of the sleeve having an increased thickness, and the section of the sleeve having an increased thickness may have projections.

In one embodiment, the sleeve may comprise a plurality of sections arranged along the non-inclining part of the sleeve and having a mutual distance between them.

The sealing elements may have a tapering or triangular cross-sectional shape.

The invention further relates to an annular barrier system comprising an expansion means and an annular barrier as described above. The expansion means may comprise explosives, pressurised fluid, cement, or a combination thereof.

In another embodiment, the annular barrier system may comprise

- a tubular part having an opening,
- a first connection part surrounding and connected with the tubular part,
- a second connection part surrounding and connected with the tubular part,
- an intermediate connection part arranged between the first and second connection parts,
- a first expandable sleeve connected with the first connection part and the intermediate connection part enclosing a first inner space, and
- a second expandable sleeve connected with the second connection part and the intermediate connection part enclosing a second inner space, wherein at least the intermediate part and the first connection part are slidably connected with the tubular part.

In one embodiment, the annular barrier system may comprise at least two annular barriers positioned at a distance from each other along the well tubular structure.

Moreover, the invention finally relates to a downhole system comprising a well tubular structure and at least one annular barrier as described above.

In one embodiment of the downhole system, a plurality of annular barriers may be positioned at a distance from each other along the well tubular structure.

BRIEF DESCRIPTION OF THE DRAWINGS

The invention and its many advantages will be described in more detail below with reference to the accompanying schematic drawings, which for the purpose of illustration show some non-limiting embodiments and in which.

Figure 1:
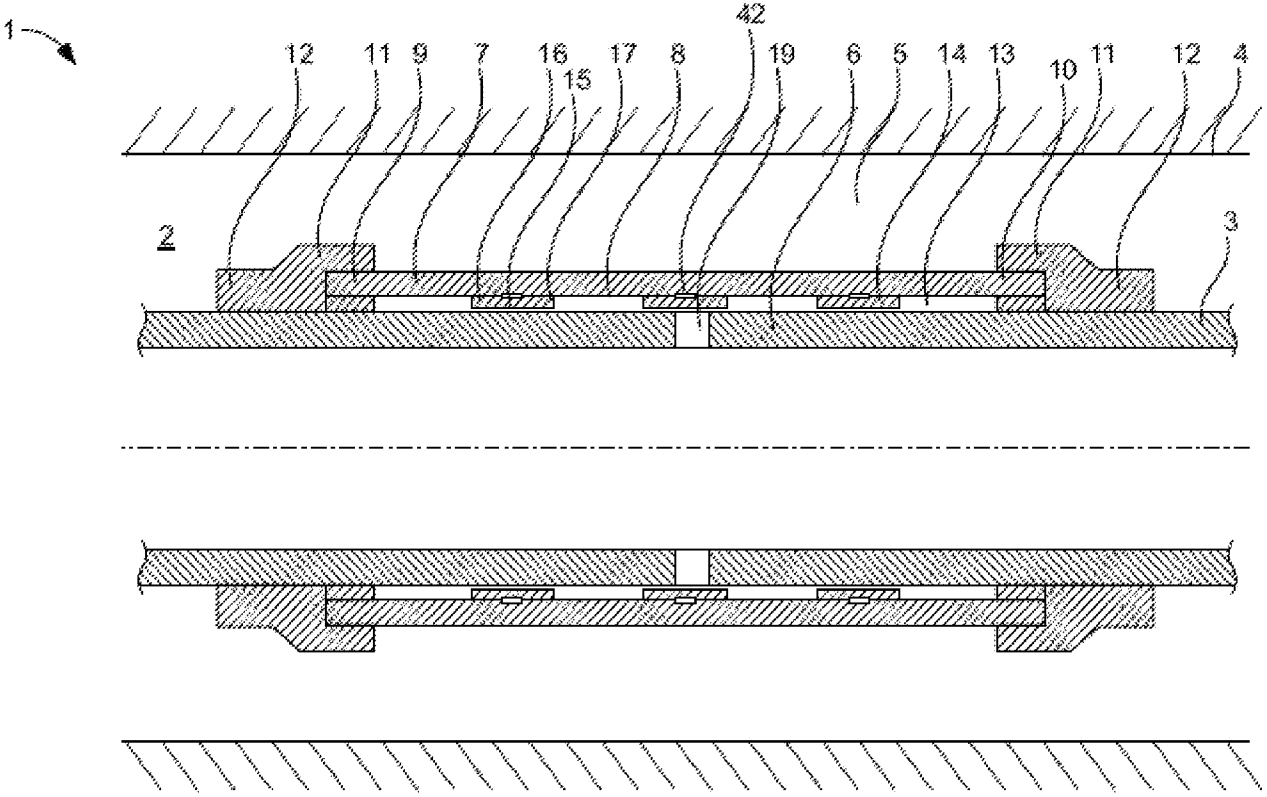
FIG. 1 shows a cross-sectional view of an annular barrier in an unexpanded condition.

All the figures are highly schematic and not necessarily to scale, and they show only those parts which are necessary in order to elucidate the invention, other parts being omitted or merely suggested.

DETAILED DESCRIPTION OF THE INVENTION

Annular barriers 1 according to the present invention are typically mounted as part of the well tubular structure string before the well tubular structure 3 is lowered into the borehole downhole. The well tubular structure 3 is constructed by well tubular structure parts put together as a long well tubular structure string. Often, the annular barriers 1 are mounted in between the well tubular structure parts when mounting the well tubular structure string.

The annular barrier 1 is used for a variety of purposes, all of which require that an expandable sleeve 7 of the annular barrier 1 is expanded so that the sleeve abuts the inside wall 4 of the borehole. The annular barrier 1 comprises a tubular part 6 which is connected to the well tubular structure 3, as shown in FIG. 1, e.g. by means of a thread connection 18.

In FIG. 1, the annular barrier 1 is shown in a cross-section along the longitudinal extension of the annular barrier. The annular barrier 1 is shown in its unexpanded state, i.e. in a relaxed position, from which it is to be expanded in an annulus 2 between a well tubular structure 3 and an inside wall 4 of a borehole 5 downhole. The annular barrier 1 comprises a tubular part 6 for mounting as part of the well tubular structure 3 and an expandable sleeve 7. The expandable sleeve 7 surrounds the tubular part 6 and has an inner face 8 facing the tubular part 6. Each end 9, 10 of the expandable sleeve 7 is fastened in a connection part 12 in the tubular part 6. The connection part 11 may comprise any kind of suitable clamping means providing a tight fastening of the sleeve 7.

As can be seen, a space or cavity 13 is formed between the inner face 8 of the sleeve 7 and the tubular part 6. In order to expand the expandable sleeve 7, pressurised fluid is injected into the cavity 13 through an expansion means 19, such as a hole 19 or a valve 19, until the expandable sleeve 7 abuts the inside wall 4 of the borehole 5. The cavity 13 may also be filled with cement or the like in order to expand the sleeve 7. The expansion means may also be an explosive.

When annular barriers 1 are expanded, they are exposed to a certain pressure. However, the pressure may vary during production. As the pressure may thus increase, the annular barrier 1 must be able to withstand an increased pressure, also called "the collapse pressure", also in its expanded state, when the outer diameter of the annular barrier is at its maximum and its wall thickness thus at its minimum. In order to withstand such an increased pressure, the expandable sleeve 7 may be provided with at least one element 14.

In FIG. 1, the expandable sleeve 7 has three elements 14 arranged spaced apart in the longitudinal direction of the expandable sleeve. Each element 14 has a first part 15, a second part 16 and a third part 17, all of which extend around and along the inner face 8 of the expandable sleeve. The second part 16 and the third part 17 are arranged on opposite sides of the first part 15, and the first part is fastened to the inner face 8. The second and third parts 16, 17 are not directly fastened to the expandable sleeve 7, but only indirectly via the first part 15. Thus, the second and third parts 16, 17 project from the first part 15 into the space 13 between the expandable sleeve 7 and the tubular part 6 and are able to move freely in the space during expansion of the expandable sleeve.

In the unexpanded state of the sleeve 7, one side of the second and third parts 16, 17 abut the inner face 8 of the sleeve extending from the first part 15 so that the first, second and third parts form a straight line and the element 14 is substantially unbent in relation to the first part which is fastened to the sleeve. Thus, the second and third parts 16, 17 project substantially in the longitudinal extension and along the inner face 8 of the sleeve with only a small gap between the inner face of the sleeve and the second and third parts. In the expanded state of the sleeve 7, the second and third parts 16, 17 project substantially radially out into the space 13 or at an angle of between 45° and 135° to the sleeve.

Figure 2:
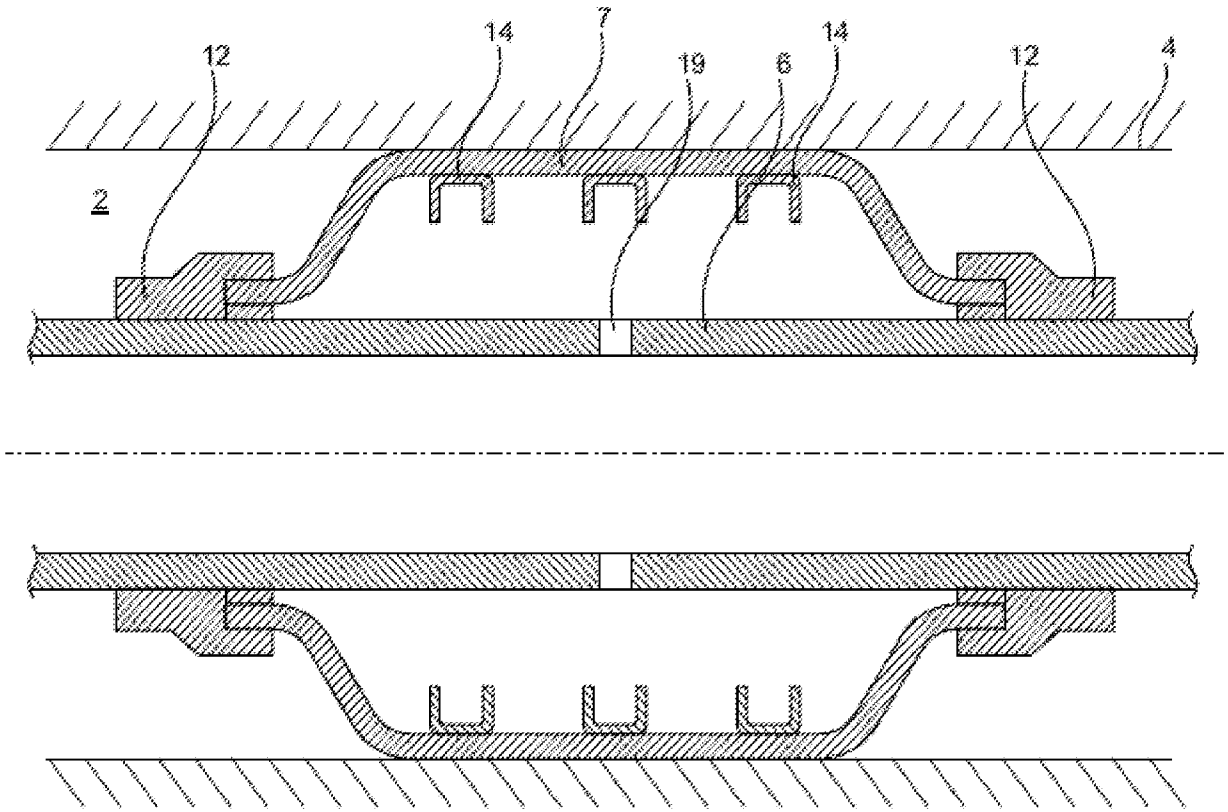
FIG. 2 shows a cross-sectional view of the annular barrier of FIG. 1 in an expanded condition.

In FIG. 2, the annular barrier 1 of FIG. 1 is shown in its expanded state. The first part 15 of each element 14 is expanded together with the expandable sleeve 7. However, the second and third parts 16, 17 are not expanded as much as the element 14, and they are thus bent at an angle in relation to the first part 15. The second and third parts 16, 17 project radially inwards in relation to the expandable sleeve 7 and function as reinforcement, such as a girder in a building or a hull of a boat. In the expanded condition, the elements 14 prevent the annular barrier from collapsing when submitted to an increased pressure from the annulus 2 or the borehole wall 4. As can be seen, all three elements 14 are positioned at the section of the sleeve 7 which in its expanded state is substantially straight and not part of the inclining ends of the annular barrier 1. The third element is positioned at the middle section of the annular barrier abutting the borehole wall 4.

Figure 3:
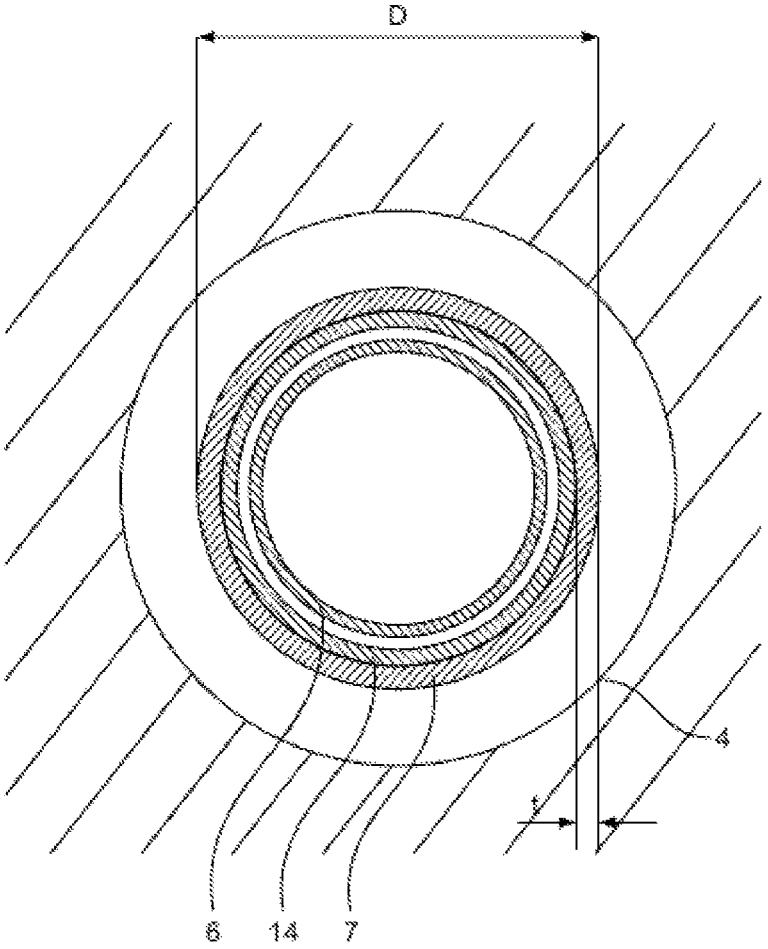
FIG. 3 shows a cross-sectional view of an annular barrier in a direction transverse to the longitudinal extension of the borehole.

FIG. 3 shows a cross-sectional view through an element connected with an annular barrier in a direction transverse to the longitudinal extension of the borehole. The element 14 is fastened to the inner face 8 of the expandable sleeve 7 and thus follows the curvature of the expandable sleeve on its inside wall. Both the expandable sleeve 7 and the element 14 surround the tubular part 6. The element 14 extends along an entire inner periphery of the sleeve 7, forming a ring or an inner sleeve.

When the expandable sleeve 7 of the annular barrier 1 is expanded, the diameter of the sleeve is expanded from its initial unexpanded diameter to a larger diameter. The expandable sleeve 7 has an outside diameter D and is capable of expanding to an at least 10% larger diameter, preferably an at least 15% larger diameter, more preferably an at least 30% larger diameter than that of an unexpanded sleeve.

Furthermore, the expandable sleeve 7 has a wall thickness t which is thinner than a length L of the expandable sleeve, the thickness preferably being less than 25% of the length, more preferably less than 15% of the length, and even more preferably less than 10% of the length.

In another embodiment, the element 14 extends both in the longitudinal extension of the expandable sleeve 7 and along the periphery of the sleeve, creating a helical path along the inner face 8 of the sleeve seen in the longitudinal direction of the sleeve.

In the embodiment shown in FIG. 1, the first part 15 is completely fastened to the inner face 8. However, the first part 15 may also be only partly fastened to the inner face 8. When the sleeve 7 is expanded, the second part 16 and the third part 17 of the element 14 function as a frame structure for the expanded sleeve due to the U-shaped cross-section of the expanded element.

The element 14 may have any suitable cross-sectional shape in the expanded state of the sleeve 7. In addition to the U-shape, a V-shape may thus be imagined, or an L-shape if the element 14 only has a first and a second part 16, 16.

When the first part 15 is fastened to the inner face 8, the second and third parts 16, 17, respectively, are able to move freely in relation to the sleeve 7. The first part 15 of the element may be fastened at the transition between the first and second/third parts or along an entire width of the first part. The first part may be fastened in any suitable way, e.g. welded, glued, bolted or riveted to the inner face 8.

The element 14 may be made of any suitable material and/or a composite able to expand and subsequently add strength to the expanded element. Examples of suitable materials are metal or polymers.

The expandable sleeve 7 of the annular barrier 1 may be made of metal or polymers, such as an elastomeric material, silicone, or natural or syntactic rubber.

Providing the annular barrier 1 with a valve 19 makes it possible to use other fluids than cement, such as the fluid present in the well or sea water, for expanding the expandable sleeve 7 of the annular barrier.

As can be seen, the expandable sleeve 7 is a thin-walled tubular structure, the ends 9, 10 of which have been inserted into the connection part 12. Subsequently, the connection part 12 has been embossed, changing the design of the fastening means and the ends 9, 10 of the expandable sleeve and thereby mechanically fastening them in relation to one another. In order to seal the connection between the expandable sleeve 7 and the connection part 12, a sealing element 20 may be arranged between them.

Figure 4A:
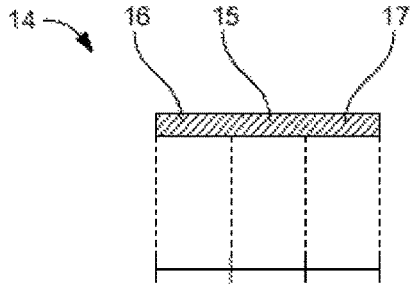
FIG. 4*a* shows a cross-sectional view of an element according to the invention in its unexpanded condition.
Figure 4B:
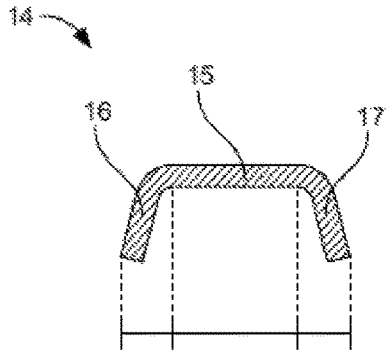
FIG. 4*b* shows a cross-sectional view of the element of FIG. 4*a* in its expanded condition.

In FIG. 4*a*, an element 14 to be connected with the inner face 8 of the expandable sleeve 7 is shown in cross-section. The element 14 comprises a first part 15, a second part 16 and a third part 17. According to the invention, the first part 15 is fastened to the inner face (not shown), whereas the second and third parts 16, 17 are not fastened and are thus free in relation to the inner face. During expansion of the expandable sleeve 7, the first part 15 of the element 14 will follow the expansion of the sleeve outwards, increasing the diameter of the first part. The second and third parts 16, 17 will follow the first part 15 in the area where they are connected, but not in their other ends. The second and third parts 16, 17 will thus project inwards at an angle from the first part 15, which is shown in FIG. 4*b*.

Figure 5A:
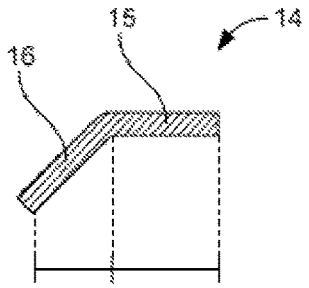
FIG. 5*a* shows a cross-sectional view of another embodiment of the element in its unexpanded condition.
Figure 5B:
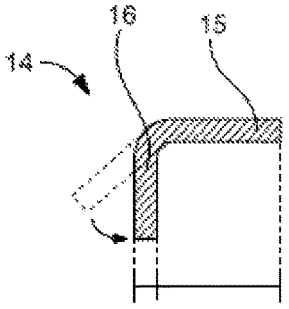
FIG. 5*b* shows a cross-sectional view of the element of FIG. 5*a* in its expanded condition.

In FIG. 5*a*, another embodiment of an element 14 is shown in cross-section. In this embodiment, the element 14 comprises a first part 15 and a second part 16, the second part having an angle in relation to the first part in a non-expanded state. As described above, the second part 16 will project inwards during expansion of the expandable sleeve 7, as shown in FIG. 5*b*. In this case, where the second part 16 already in the non-expanded state projects inwards, less expansion force is required.

Furthermore, the second part 16 and/or the third part 17 may be arranged at an angle in relation to the first part 15, away from the inner face 8. The second part 16 and/or the third part 17 may comprise an additional flange arranged at the end furthest away from the first part 15, providing these parts with extra strength, thus increasing the collapse rating of the expanded sleeve 7 even further.

Figure 6:
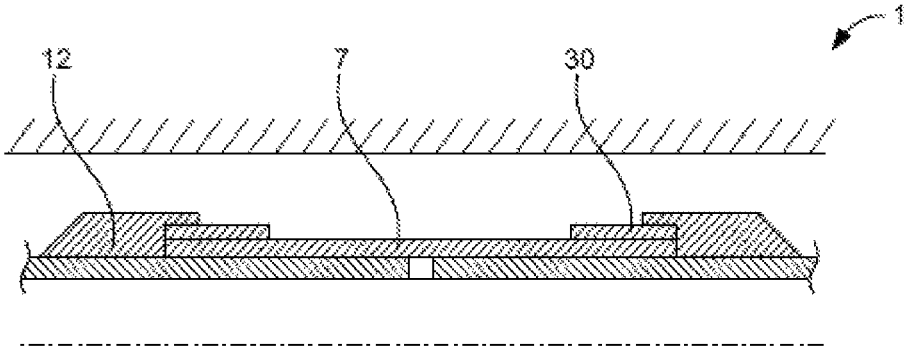
FIG. 6 shows a cross-sectional view of another embodiment of an annular barrier in an unexpanded condition.

In FIG. 6, another annular barrier 1 is shown, wherein the expandable sleeve 7 of the annular barrier 1 has been laminated with an additional material 30 in predetermined areas, i.e. in those areas where the expanded sleeve 7 is exposed to maximum hydraulic pressure. Advantageously, this additional material 30 may be stronger than the material of which the rest of the expandable sleeve is made.

Normally, a stronger material will be less ductile. When only laminating the expandable sleeve 7 with the additional stronger material 30 in certain areas, an increased collapse rating of the expandable sleeve may, however, be achieved without affecting the expansion properties of sleeve.

Lamination of the expandable sleeve 7 may be performed in many different ways, e.g. by laser welding of dissimilar metals, cladding, etc.

When a stronger but less ductile material 30 is laminated onto the expandable sleeve 7, the material of which is not quite as strong, but more ductile, the result is an expandable sleeve which is still sufficiently ductile, but the collapse rating of which is increased. In its expanded state, the sleeve 7 will thus be able to withstand a higher pressure close to or at the point of lamination.

Figure 8:
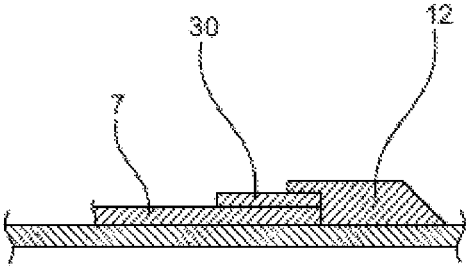
FIG. 8 shows an enlarged partial view of FIG. 6.

When the expandable sleeve 7 is laminated with an additional material 30 in certain areas, the wall thickness of the sleeve is increased in these areas. This increase in the wall thickness is easier deduced from FIG. 8.

Figure 7:
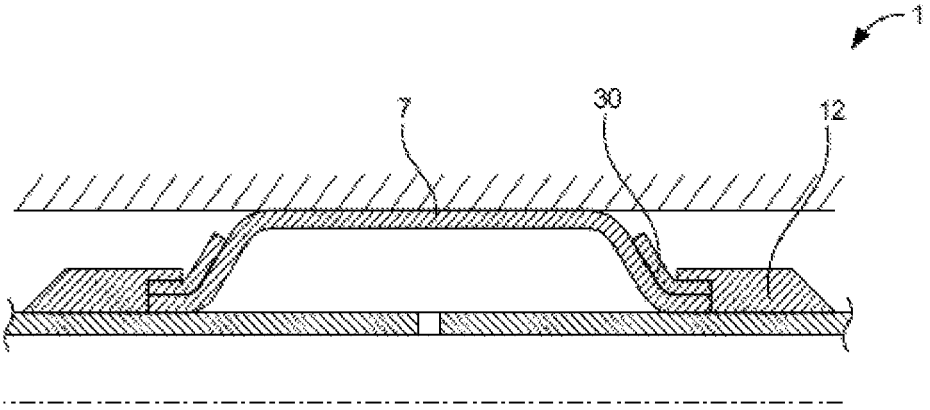
FIG. 7 shows a cross-sectional view of the annular barrier of FIG. 6 in an expanded condition.

In FIG. 7, a cross-sectional view of the annular barrier 1 of FIG. 6 in its expanded state is shown. In this embodiment, the additional material 30 with which the sleeve has been laminated provides an increased collapse rating of the expandable sleeve and thus of the annular barrier 1.

In another aspect, the expandable sleeve may comprise at least two different materials, one having a higher strength and thereby lower ductility than the other material having a lower strength but higher ductility. Hereby, the expandable sleeve may comprise the material having the higher strength in areas of the sleeve which are exerted for high hydraulic collapse pressure, when the sleeve is expanded, and comprise the material having a lower strength in the remaining areas of the sleeve. When the expandable sleeve comprise a material of higher strength with low ductility in certain areas and having a material of lower strength but high ductility in the remaining areas, the expandable sleeve maintains sufficient ductility whilst the lower strength expandable sleeve material gains in collapse resistance. Once expanded, the overall effect being an expandable sleeve with a higher collapse resistance close to or at the areas where the sleeve comprises the material of higher strength.

Figure 9:
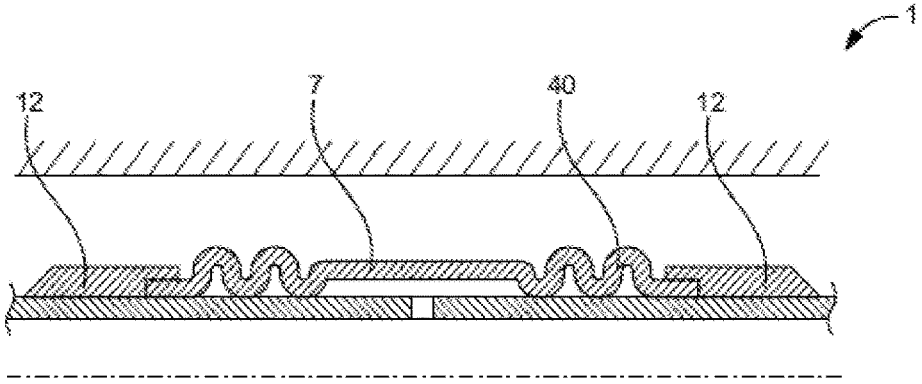
FIG. 9 shows a cross-sectional view of yet another annular barrier in an unexpanded condition.

In FIG. 9 another aspect is shown, wherein both ends 9, 10 of the expandable sleeve 7 are fixed to the well tubular structure 3. Normally, when the expandable sleeve 7 expands diametrically outwards, the increase in diameter of the expandable sleeve will cause the length of the sleeve to shrink and the thickness of the wall of the sleeve to become somewhat decreased.

If two ends 9, 10 of the sleeve are fixed and no other changes are made to the design of prior art annular barriers, the degree to which the wall thickness would have to be decreased to achieve high diametrical expansion would be increased, leading to a lower collapse rating and possible burst of material.

In an additional aspect, the expandable sleeve 7 is provided with a series of circumferential corrugations 40 along the length of the expandable sleeve. The series of circumferential corrugations 40 enables an increase in the length of the expandable sleeve 7 between the two fixed ends 9, 10 without increasing the distance between the two fixed ends.

After forming the above-mentioned corrugations 40, the expandable sleeve 7 may be subjected to some kind of treatment, e.g. heat treatment, to return the material of the sleeve to its original metallurgical condition.

Figure 10:
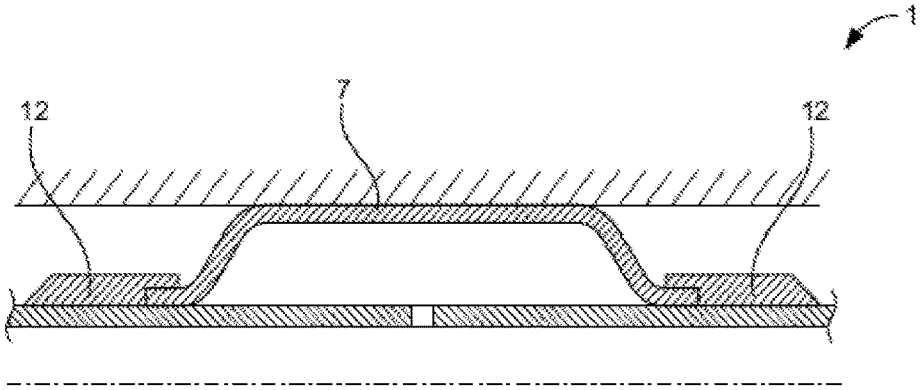
FIG. 10 shows a cross-sectional view of the annular barrier of FIG. 9 in an expanded condition.

During expansion of the expandable sleeve 7, the corrugations 40 are straightened out, providing the additional material necessary for large diametrical expansion (e.g. 40% in diameter) without overly decreasing the wall thickness and while still keeping the two ends 9, 10 fixed. This is shown in FIG. 10. Preventing excessive decrease in wall thickness will maintain the collapse rating of the expandable sleeve 7, which will be appreciated by the skilled person.

Fixing the two ends 9, 10 while at the same time achieving maximum diametrical expansion capability (e.g. 40% in diameter) is particularly advantageous in that it eliminates moving parts and thus the expensive and risky high pressure seals required for these moving parts. This is of particular importance in regard to high temperatures or corrosive well environments, e.g. Acid, $H_2S$, etc.

In another aspect, the wall thickness of the expandable sleeve along the length of the sleeve may be profiled, which will allow control of the expansion in relation to where wall thinning would occur of the expandable sleeve. The profiling may be made to the expandable sleeve via laminating of the same or different materials to the surface of the expansion sleeve or could be via machining or rolling the expandable sleeve to varying thicknesses.

When the expansion is controlled through varying the wall thickness, it is possible to vary the collapse rating at certain points along the length of the expandable sleeve.

Figure 11:
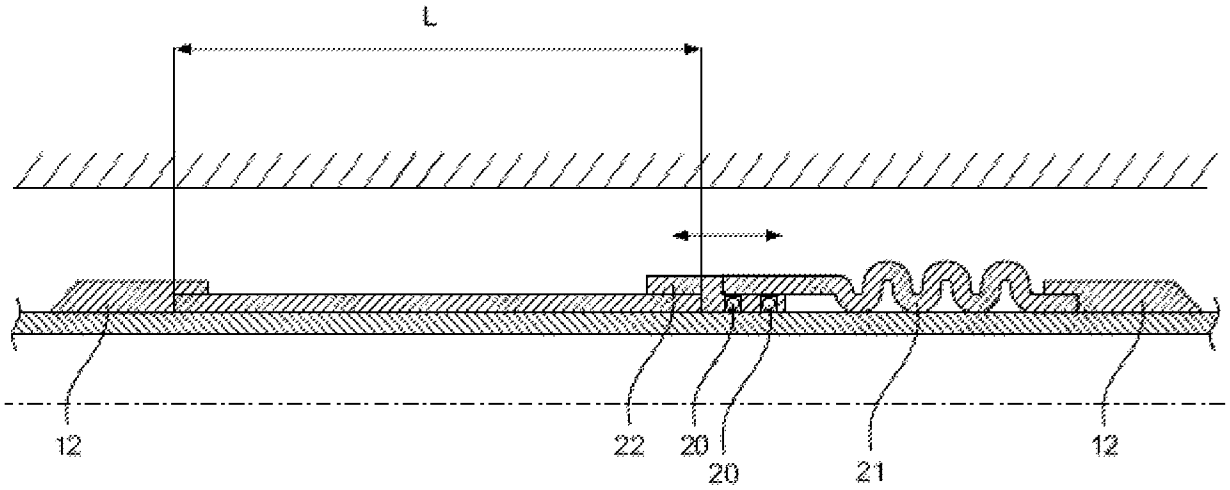
FIG. 11 shows a cross-sectional view of yet another embodiment of an annular barrier.

Another aspect of the annular barrier 1 is shown in FIG. 11. In one end of the annular barrier 1, the connection part 12 in which the sleeve 7 is fastened is slidably connected with the tubular part 6 (illustrated by an arrow) via slidable fastening means 22. When the expandable sleeve 7 is expanded in a direction transverse to the longitudinal direction of the annular barrier 1, the sleeve will, as mentioned above, tend to shorten in its longitudinal direction, if possible. When having slidable fastening means 22, the length of the sleeve 7 may be reduced, making it possible to expand the sleeve even further, since the sleeve is not stretched as much as when it is fixedly connected with the tubular part 6.

However, having slidable fastening means 22 increases the risk of the seals 20 becoming leaky over time. A bellow 21 is therefore fastened to the slidable fastening means 22 and fixedly fastened in the connection part 12. In this way, the connection parts 12 can be fixedly connected to the tubular part 6. The expandable sleeve 7 is firmly fixed to the first connection part 12 and to the slidable fastening means 22, and the bellow 21 is firmly fixed to the slidable fastening means 22 and the second connection part 12. Accordingly, the connection parts 12, the expandable sleeve 7, the slidable fastening means 22 and the bellow 21 together form a tight connection preventing well fluid from entering the tubular structure 3.

The incorporation of two ends fixed with maximum diametrical expansion capability is considered beneficial in that this would eliminate moving parts, and no expensive and risky high pressure seals within these moving parts are needed. This is of particular importance when considering high temperature or corrosive well environments, e.g. Acid, $H_2S$ etc.

When the annular barrier 1 has slidable fastening means 22 between the sleeve 7 and the tubular part 6, the expansion capability of the sleeve is increased by up to 100% compared to an annular barrier without such slidable fastening means.

Figure 12:
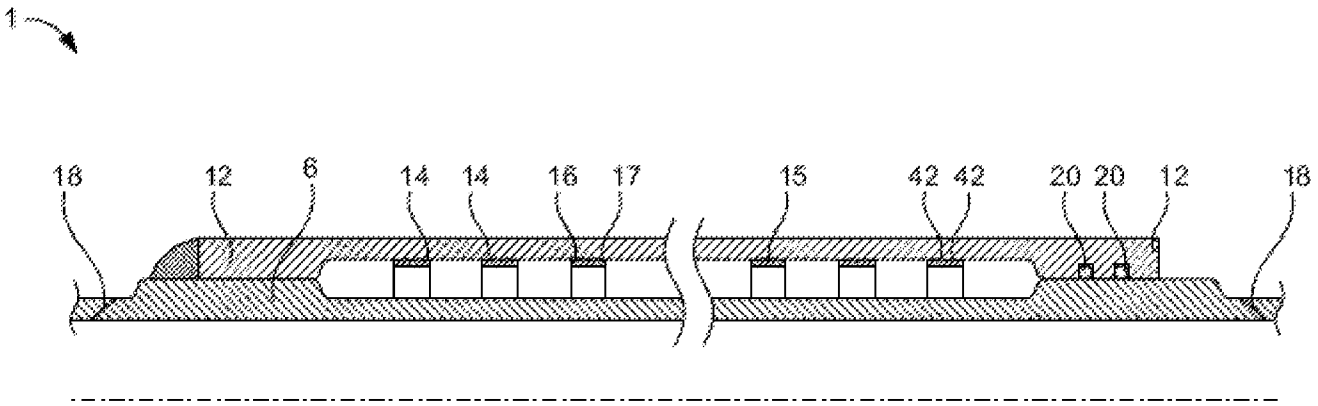
FIG. 12 shows a cross-sectional view of yet another embodiment of an annular barrier.
Figure 13:
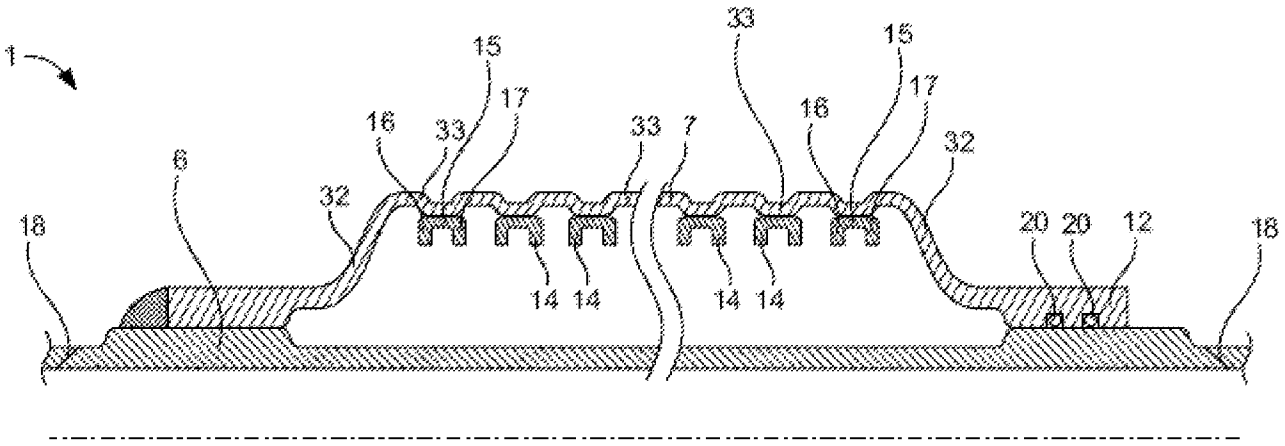
FIG. 13 shows a cross-sectional view of the annular barrier of FIG. 12 in an expanded condition.

In FIGS. 12 and 13, the annular barrier 1 has six elements 14 of which three are arranged in one end of the sleeve 7 and three are arranged in the other. In FIG. 12, the sleeve 7 has not yet been expanded, but in FIG. 13, it is shown in its expanded condition. The sleeve 7 has two inclining parts 32 and one intermediate non-inclining part 33. The elements 14 are situated so that none of them are fastened in the part of the sleeve 7 inclining after expansion, but they are all positioned at a substantially straight non-inclining part 33 of the sleeve after expansion. The first part 15 of the elements 14 is welded to the inner face 8 of the sleeve 7 forming a welded connection 42, and the second and third parts 16, 17 of the element 14 are not fastened to the sleeve, but are free to move during expansion.

When placed near the inclining part, as shown in FIG. 13, the six elements 14 increase the collapse pressure even further than when placed closer to the middle of the sleeve 7.

Figure 14:
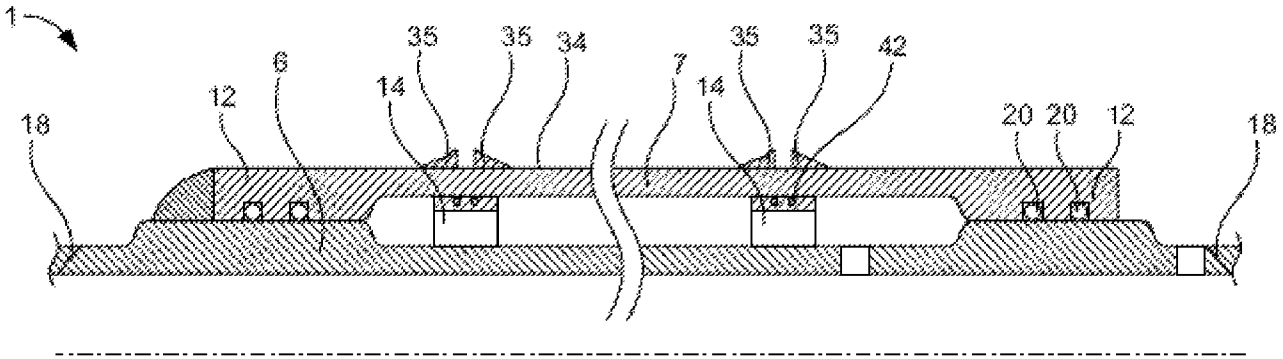
FIG. 14 shows a cross-sectional view of yet another embodiment of an annular barrier.
Figure 15:
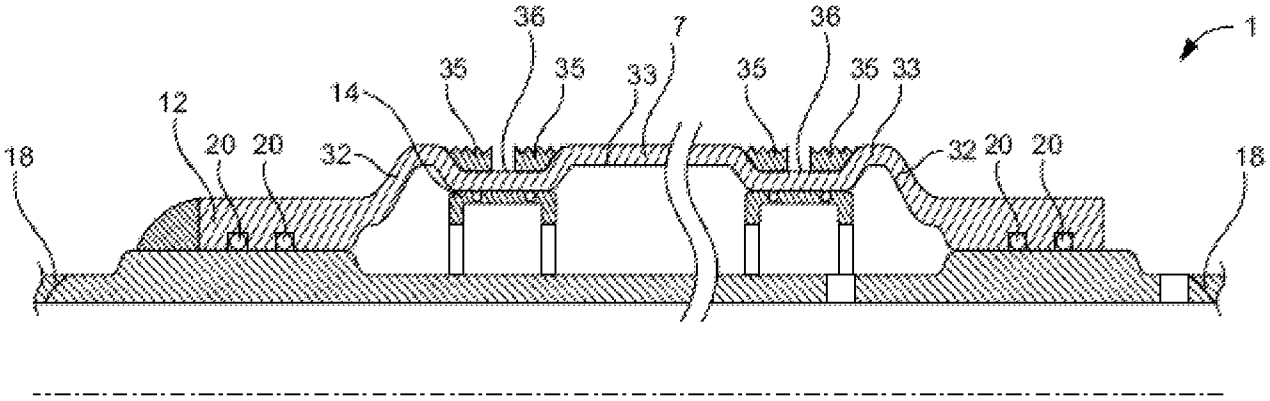
FIG. 15 shows a cross-sectional view of the annular barrier of FIG. 14 in an expanded condition.

In FIG. 14, the sleeve 7 has an outer face 34 having two sealing elements 35 opposite the first part 15 of each element 14. When expanded, as shown in FIG. 15, the sealing elements 35 fit into the groove 36 created by the element due to the increased thickness of the sleeve 7 and the first part 15 of the element.

The sealing elements 35 have an outer corrugated face for increasing the sealing ability. The sealing elements 35 have a triangular cross-sectional shape so as to fit the groove 36 occurring in the sleeve 7 during expansion. The sealing elements 35 are made of an elastomer or the like material having a sealing ability and being flexible.

Figure 16:
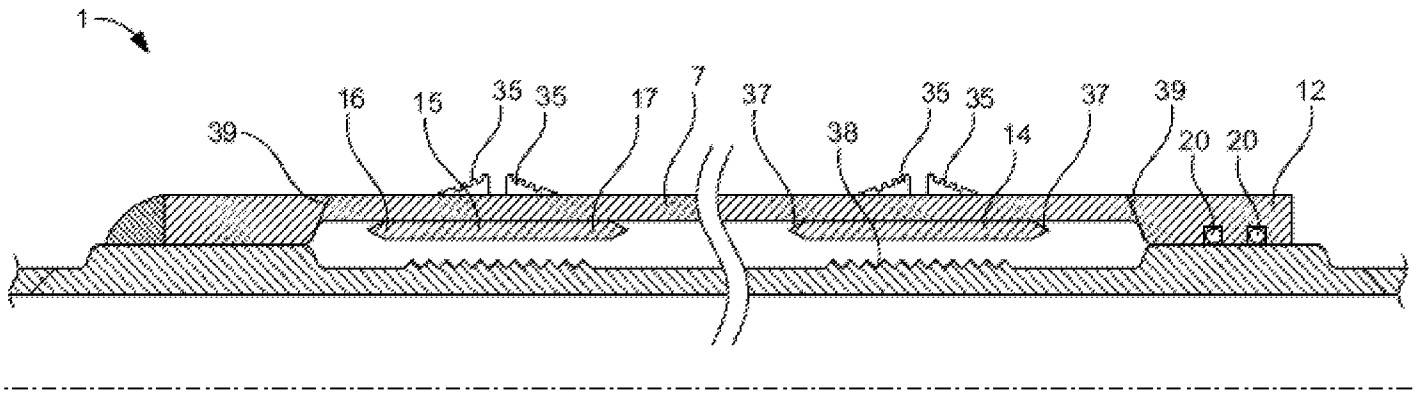
FIG. 16 shows a cross-sectional view of yet another embodiment of an annular barrier.
Figure 17:
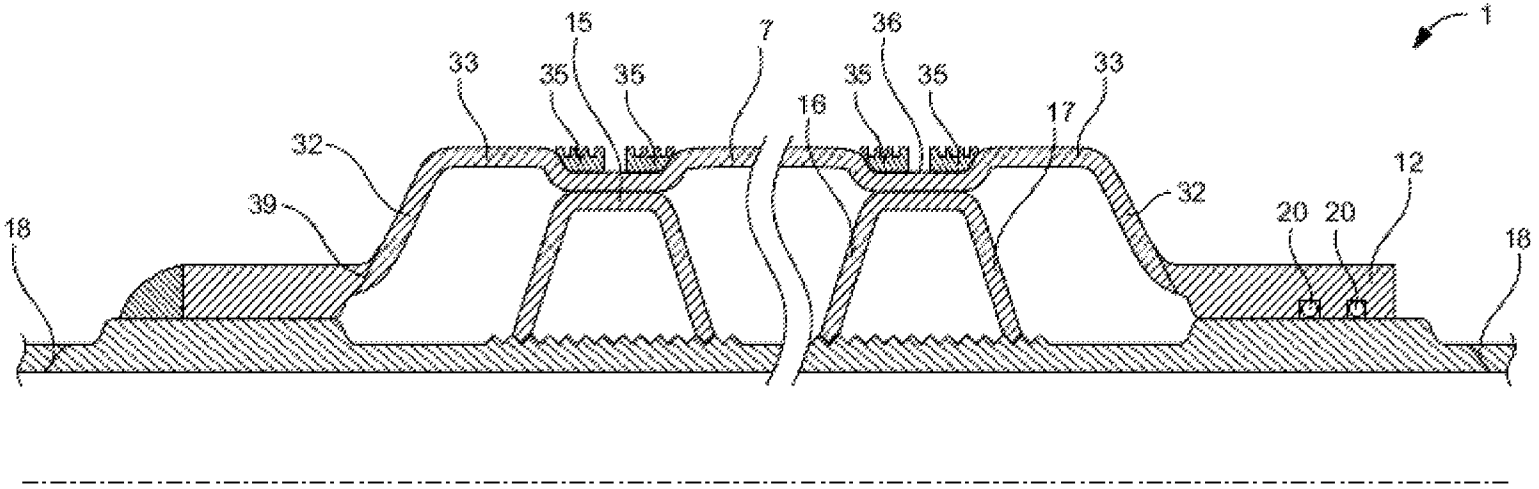
FIG. 17 shows a cross-sectional view of the annular barrier of FIG. 16 in an expanded condition.

In FIGS. 16 and 17, the outer surface of the tubular part 6 of the annular barrier 1 has a serrated configuration, and the elements have corresponding points 37 at their ends matching the serrated surface of the tubular part. When the sleeve 7 is expanded, as shown in FIG. 17, the points of the elements are fixated in the serrations 38 of the tubular part, and the ends of the elements are maintained in this position, thereby strengthening the collapse pressure.

The elements are arranged in the non-inclining part of the sleeve 7, and the second and third parts 16, 17 of each element are long enough the reach the outer face of the tubular part 6 so as to fit into the serrations 38 and be fastened in these serrations. The tubular part 6 has several serrations so to fit several expansion diameters of the sleeve 7. By having several serrations, the annular barrier 1 is able fit even if the sleeve 7 is expanded in an uneven manner, causing a part of the sleeve to be expanded less than another part.

Furthermore, the connection parts 12 of the annular barrier 1 of FIGS. 16 and 17 are made of a different material than the expandable sleeve 7. The connection parts 12 are welded with the sleeve 7 when manufacturing the annular barrier 1.

By collapse pressure is meant the pressure by which an outside pressure can collapse an expanded sleeve 7. The higher the collapse pressure, the higher the pressure from the formation and the annulus the expanded sleeve 7 is able to withstand before collapsing.

Figure 18:
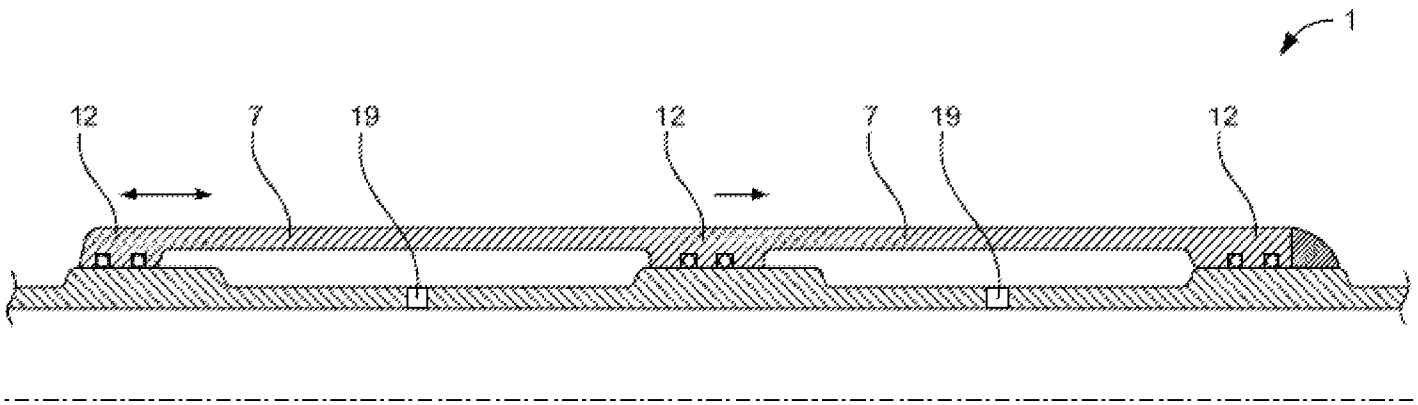
FIG. 18 shows a cross-sectional view of yet another embodiment of an annular barrier

In FIG. 18, a double annular barrier is shown. The annular barrier 1 has two end connection parts 12 and a middle connection part. The two expandable sleeves 7 are fastened to one end connection part and the middle part, as shown in FIG. 18. The middle connection part is slidable as is one of the end connection parts 12. The other end connection part 12 is firmly fastened to the tubular part 6. The annular barrier 1 has two openings for injection of pressured fluid for expansion of the sleeves 7.

Figure 19:
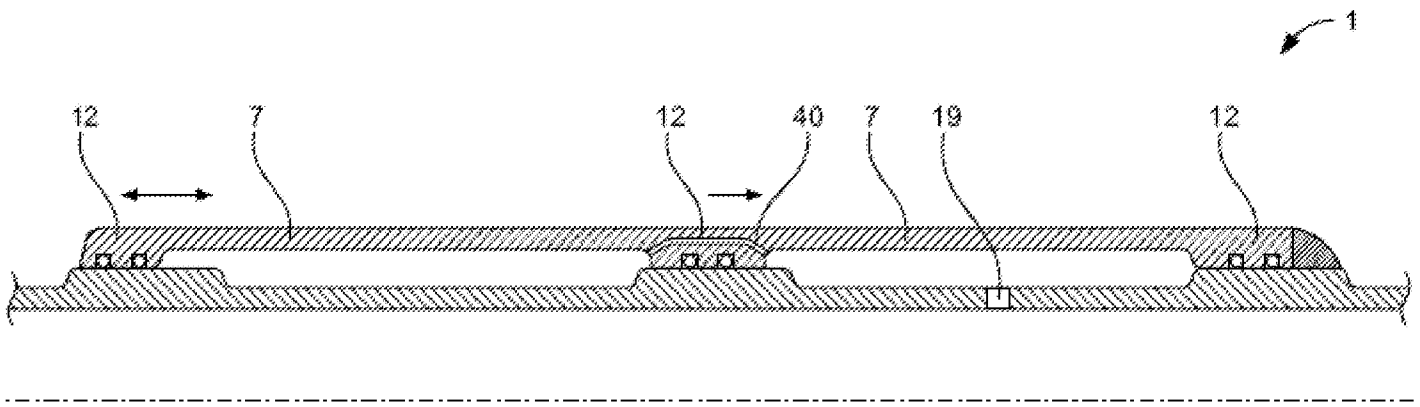
FIG. 19 shows a cross-sectional view of the annular barrier of FIG. 18 in an expanded condition.

FIG. 19 shows another embodiment of a double annular barrier having only one opening for injection of pressured fluid for expansion of the sleeves 7. The annular barrier 1 has two cavities, and the middle connection part 12 has a channel 40 fluidly connecting the two cavities so that fluid for expanding the cavity having the opening is able to flow through the channel to expand the other sleeve 7 as well.

Figure 20:
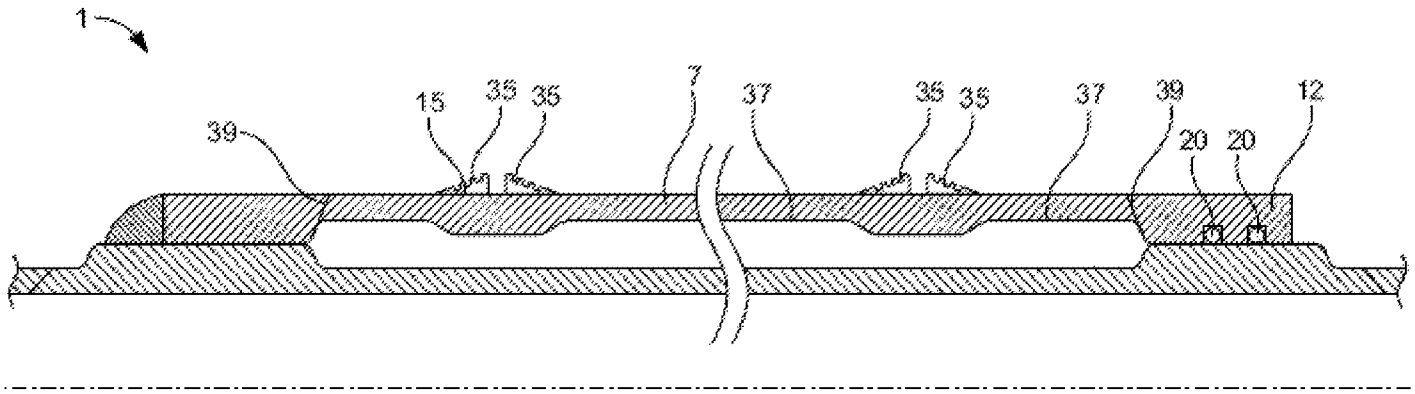
FIG. 20 shows a cross-sectional view of yet another embodiment of an annular barrier.

In order to increase the collapse pressure, a circumferential section 41 of the intermediate non-inclining part 33 may have an increased thickness when seen in a cross-sectional view along the longitudinal extension of the sleeve 7 as shown in FIG. 20. When expanding the sleeve 7, this section 41 of the sleeve is expanded less than another section along the non-inclining part 33, resulting in a corrugated shape of the sleeve.

In order to increase the thickness of a section 41 of the sleeve 7, additional material is applied onto the inner face 8 of the sleeve, e.g. by adding welded material onto the inner face.

In another embodiment, the thickness of the section of the sleeve 7 is increased by fastening a ring-shaped part onto the sleeve. The ring-shaped part is the element 14 and is fastened onto the inner surface by means of welding or the like suitable fastening process.

As shown in FIG. 20, the section 41 of the sleeve 7 having an increased thickness has two inclining end parts in which the thickness of the sleeve increases. Thus, the added material may be applied to the inner and/or outer face of the sleeve, increasing the thickness of the end parts of the section towards the centre of the section. In addition, the fastened ring-shaped part 14 is chamfered after the fastening process.

Along the non-inclining part 33, the sleeve 7 may also have an increased thickness on its outside and the sleeve may also have a ring-shaped part fastened to the outer face 34 of the sleeve.

Figure 21:
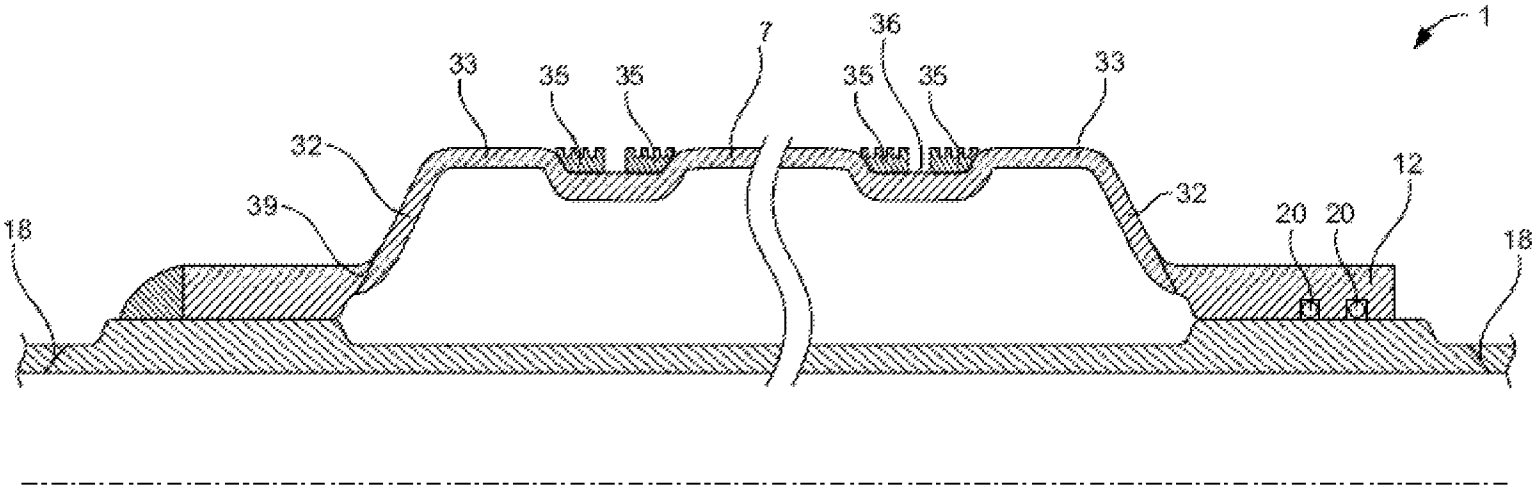
FIG. 21 shows a cross-sectional view of the annular barrier of FIG. 20 in an expanded condition.

On the outer face 34 of the expandable sleeve, sealing elements 35 are arranged opposite the sections of the sleeve having an increased thickness. When the sleeve 7 is expanded as shown in FIG. 21, the sealing elements 35 fill up the gap occurring during expansion. In order to fit the gap better, the sealing elements 35 have a tapering or triangular cross-sectional shape.

Also as shown in FIG. 20, a connection 39 is positioned between the sleeve 7 and the connection part 12. The connection 39 may e.g. be provided by means of welding.

Figure 22A:
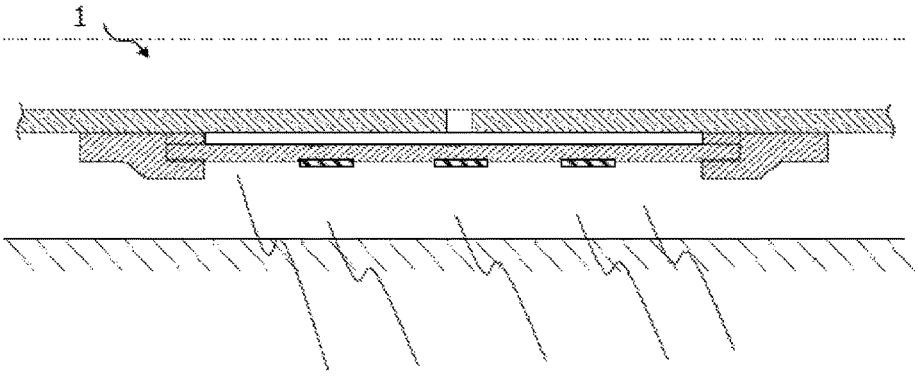
FIG. 22A-D show a cross-sectional view of other embodiments of an annular barrier.

In FIG. 22A, the sleeve 7 of the annular barrier 1 has three elements 14 fastened on the outer face 34 of the sleeve, increasing the thickness of the sleeve wall. The element is a ring fastened by means of welding. During expansion of the sleeve 7, the elements 14 arranged on the outer face 34 prevents the sleeve from expanding freely in these section. Consequently, the sleeve 7 is expanded to a lesser extent in these sections than in other sections and the cross-sectional shape of the sleeve is a corrugated.

Figure 22B:
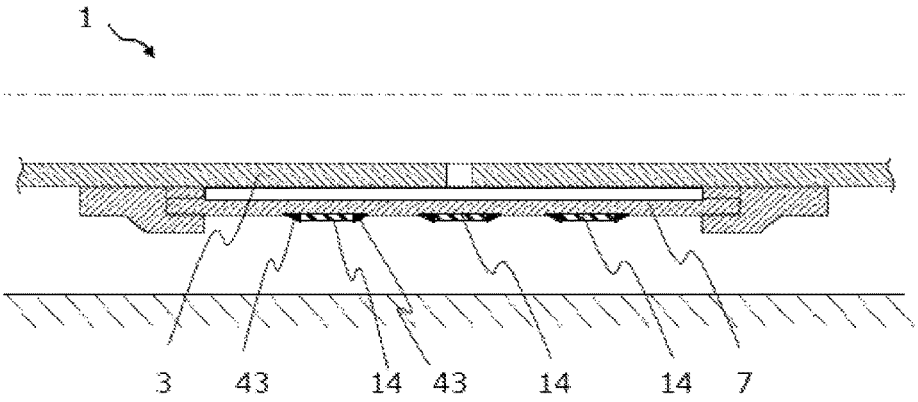

In FIG. 22B, the three elements 14 of FIG. 22A have been welded along each of their circumferential edges. The welded material 43 is applied in the transition between the element 14 and the sleeve 7 and provides the element with a tapering cross-sectional shape resulting in a more controlled curvature of the sleeve. The welded material 43 may also be chosen as being more corrosion-resistant or providing another property. During expansion of the sleeve 7, the elements 14 arranged on the outer face 34 prevents the sleeve from expanding freely in these section. Consequently, the sleeve 7 is expanded to a lesser extent in these sections than in other sections and the cross-sectional shape of the sleeve is a corrugated.

Figure 22C:
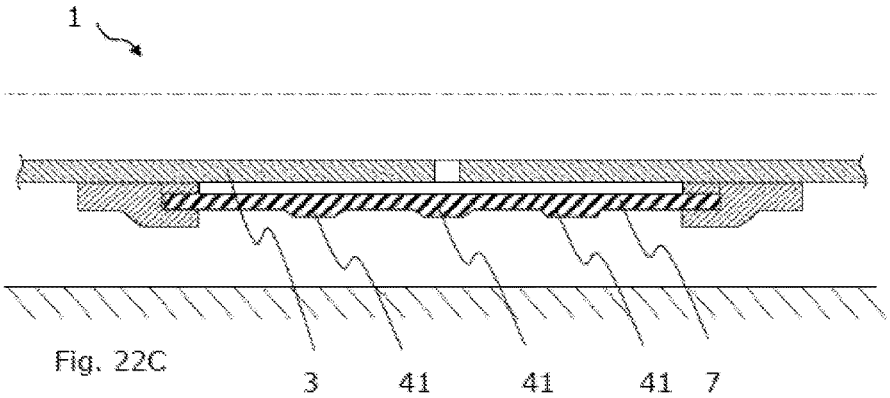

In FIG. 22C, the sleeve 7 has three sections 41 with an increased wall thickness. The thickness of the sleeve wall is increasing outwards in a radial direction, providing the sleeve with projections extending circumferential outwards. In this embodiment, the elements 14 arranged on the outer face 34 thus also prevents the sleeve from expanding freely in these section. Consequently, the sleeve 7 is expanded to a lesser extent in these sections than in other sections and the cross-sectional shape of the sleeve is a corrugated.

Figure 22D:
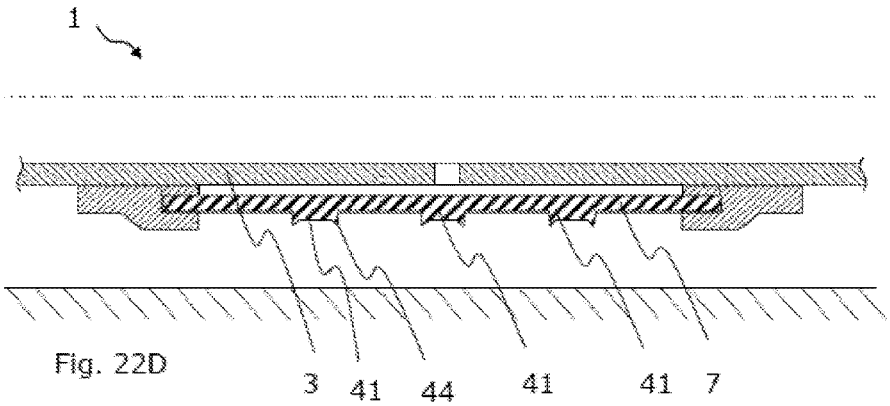

In FIG. 22D, the sections 41 having an increased thickness are provided with projections 44 in the form of peaking edges or several spikes in order to obtain a metal-to-metal seal when the sleeve 7 is expanded. On one or both sides of the peaking edges or spikes, O-rings may be arranged around the sleeve 7 to provide a better seal.

The corrugated cross-sectional shape which the sleeve 7 obtains during expansion serves to increase the collapse pressure is substantially. This corrugated cross-sectional shape is obtained by providing elements 14 on the inner and/or outer face of the sleeve 7, or by providing the sleeve with an increased thickness in certain sections 41.

The sleeve 7 has a longitudinal extension along its centre axis, shown in FIGS. 2, 6, 7, and 9-22B as a dotted line. The cross-sectional views of these figures are rotational symmetric around the centre axis.

The present invention also relates to an annular barrier system comprising an annular barrier 1 as described above. The annular barrier system moreover comprises an expansion tool for expanding the expandable sleeve 7 of the annular barrier 1. The tool expands the expandable sleeve 7 by applying pressurised fluid through a passage 19 in the tubular part 6 into the space 13 between the expandable sleeve and the tubular part.

The expansion tool may comprise an isolation device for isolating a first section outside the passage or valve 19 between an outside wall of the tool and the inside wall of the well tubular structure 3. The pressurised fluid is obtained by increasing the pressure of the fluid in the isolation device. When a section of the well tubular structure 3 outside the passage 19 of the tubular part 6 is isolated, it is not necessary to pressurise the fluid in the entire well tubular structure just as no additional plug is needed, as is the case in prior art solutions. When the fluid has been injected into the cavity 13, the passage or valve 19 is closed.

In the event that the tool cannot move forward in the well tubular structure 3, the tool may comprise a downhole tractor, such as a Well Tractor®.

The tool may also use coiled tubing for expanding the expandable sleeve 7 of an annular barrier 1 or of two annular barriers at the same time. A tool with coiled tubing can pressurise the fluid in the well tubular structure 3 without having to isolate a section of the well tubular structure; however, the tool may need to plug the well tubular structure further down the borehole from the two annular barrier or barriers 1 to be operated. The annular barrier system of the present invention may also employ a drill pipe or a wireline tool to expand the sleeve 7.

In one embodiment, the tool comprises a reservoir containing the pressurised fluid, e.g. when the fluid used for expanding the sleeve 6 is cement, gas or a two-component compound.

An annular barrier 1 may also be called a packer or the like expandable means. The well tubular structure 3 can be the production tubing or casing or a similar kind of tubing downhole in a well or a borehole. The annular barrier 1 can be used both in between the inner production tubing and an outer tubing in the borehole or between a tubing and the inner wall of the borehole. A well may have several kinds of tubing, and the annular barrier 1 of the present invention can be mounted for use in all of them.

The valve 19 may be any kind of valve capable of controlling flow, such as a ball valve, butterfly valve, choke valve, check valve or non-return valve, diaphragm valve, expansion valve, gate valve, globe valve, knife valve, needle valve, piston valve, pinch valve or plug valve.

The expandable tubular metal sleeve 7 may be a cold-drawn or hot-drawn tubular structure.

The fluid used for expanding the expandable sleeve 7 may be any kind of well fluid present in the borehole surrounding the tool and/or the well tubular structure 3. Also, the fluid may be cement, gas, water, polymers, or a two-component compound, such as powder or particles mixing or reacting with a binding or hardening agent. Part of the fluid, such as the hardening agent, may be present in the cavity 13 before injecting a subsequent fluid into the cavity.

Although the invention has been described in the above in connection with preferred embodiments of the invention, it will be evident for a person skilled in the art that several modifications are conceivable without departing from the invention as defined by the following claims.

The invention claimed is:

1. An annular barrier to be expanded in an annulus between a well tubular structure and an inside wall of a borehole downhole, comprising:

a tubular part for mounting as part of the well tubular structure, an expandable sleeve of metallic material surrounding the tubular part and having an inner face facing the tubular part, each end of the expandable sleeve being connected with a connection part which is connected with the tubular part, a space between the inner face of the sleeve and the tubular part configured to receive pressurized fluid or cement to expand the expandable sleeve under an expansion pressure, and an element configured and arranged to be a first section of the sleeve having an increased thickness in relation to a second section of the sleeve when seen in cross-section along a longitudinal extension of the sleeve, causing the section having the increased thickness to be expanded less than another section during expansion of the sleeve, whereby the increased thickness results in increased collapse rating of the sleeve without increasing the expansion pressure required to expand the sleeve.

2. The annular barrier according to claim 1, wherein the element includes a ring-shaped part fastened onto the sleeve.

3. The annular barrier according to claim 1, wherein the element is positioned in the space and projects radially inwards towards the tubular part.

4. The annular barrier according to claim 1, wherein the sleeve has an exterior metal surface adapted to directly engage and contact the inside wall of the borehole.

5. An annular barrier to be expanded in an annulus between a well tubular structure and an inside wall of a borehole downhole, comprising:

a tubular part for mounting as part of the well tubular structure, an expandable sleeve of metallic material surrounding the tubular part and having an inner face facing the tubular part, each end of the expandable sleeve being connected with a connection part which is connected with the tubular part, a space between the inner face of the sleeve and the tubular part configured to contain pressurized fluid or cement to expand the expandable sleeve under an expansion pressure, and an element configured and arranged to be a first section of the sleeve having an increased thickness in relation to a second section of the sleeve when seen in cross-section along a longitudinal extension of the sleeve, causing the section having the increased thickness to be expanded less than another section during expansion of the sleeve, thereby increasing the collapse rating of the sleeve without materially affecting expansion properties of the sleeve.

6. The annular barrier according to claim 5, wherein the sleeve after expansion has two inclining parts and an intermediate non-inclining part when seen in cross-section along a longitudinal extension of the sleeve, and the element is arranged on the part of the sleeve which is non-inclining.

7. The annular barrier according to claim 5, wherein the element is made of a material able to maintain its shape after being bent.

8. The annular barrier according to claim 5, wherein the expandable sleeve has an outer face onto which at least one sealing element is arranged.

9. The annular barrier according to claim 8, wherein the sealing elements have a tapering or triangular cross-sectional shape.

10. The annular barrier according to claim 5, wherein the element includes a ring-shaped part fastened onto the sleeve.

11. The annular barrier according to claim 5, wherein the section of the sleeve having an increased thickness has two inclining end parts in which the thickness of the sleeve increases.

12. The annular barrier according to claim 5, wherein the expandable sleeve has an outer face onto which at least one sealing element is arranged opposite the section of the sleeve having an increased thickness.

13. An annular barrier system comprising a supply of pressurized gas or cement and the annular barrier according to claim 5.

14. A downhole system comprising a well tubular structure and at least one said annular barrier according to claim 5.

15. The downhole system according to claim 14, wherein a plurality of annular barriers are positioned at a distance from each other along the well tubular structure.

16. The annular barrier according to claim 5, wherein the element is positioned in the space and projects radially inwards towards the tubular part.

17. The annular barrier according to claim 5, wherein the sleeve has an exterior metal surface adapted to directly engage and contact the inside wall of the borehole.

* * * * *